US008776436B2

(12) United States Patent
Miller et al.

(10) Patent No.: US 8,776,436 B2
(45) **Date of Patent: *Jul. 15, 2014**

(54) CABINET MOUNTED OSCILLATING SELF-CENTERING CAFE-DOOR

(75) Inventors: Peter Miller, Wauconda, IL (US); Duer Miller, Wauconda, IL (US)

(73) Assignee: Mueller Door Co., Inc., Wauconda, IL (US)

( * ) Notice: Subject to any disclaimer, the term of this patent is extended or adjusted under 35 U.S.C. 154(b) by 588 days.

This patent is subject to a terminal disclaimer.

(21) Appl. No.: 12/826,325

(22) Filed: Jun. 29, 2010

(65) Prior Publication Data

US 2010/0325963 A1 Dec. 30, 2010

Related U.S. Application Data

(63) Continuation-in-part of application No. 12/079,772, filed on Mar. 28, 2008, now abandoned, and a continuation-in-part of application No. 11/371,518, filed on Mar. 8, 2006, now abandoned, said application No. 12/079,772 is a continuation-in-part of application No. 11/371,438, filed on Mar. 8, 2006, now Pat. No. 8,112,939.

(60) Provisional application No. 61/221,338, filed on Jun. 29, 2009, provisional application No. 60/762,399, filed on Jan. 26, 2006.

(51) Int. Cl.
*E05D 7/06* (2006.01)
*E05F 1/04* (2006.01)

(52) U.S. Cl.
USPC ..... 49/236

(58) Field of Classification Search
USPC ..... 49/381, 342, 345, 208, 236, 237, 238, 49/239
See application file for complete search history.

(56) References Cited

U.S. PATENT DOCUMENTS

| | | | | | |
|---|---|---|---|---|---|
| 4,292,764 | A | * | 10/1981 | Kochis | 49/237 |
| 4,635,421 | A | * | 1/1987 | Newberg | 52/309.11 |
| 4,956,954 | A | * | 9/1990 | Horgan, Jr. | 52/204.53 |
| 5,025,531 | A | * | 6/1991 | McCarty | 16/313 |
| 5,129,195 | A | * | 7/1992 | Austin et al. | 49/501 |

* cited by examiner

*Primary Examiner* — Jerry Redman
(74) *Attorney, Agent, or Firm* — Gregory B. Gulliver; The Eclipse Group LLP

(57) ABSTRACT

A café door with a beam and a panel where the beam contains an oscillator and the beam is secured to the door panel and supported by a vertical surface.

14 Claims, 17 Drawing Sheets

CABINET MOUNTED OSCILLATING SELF-CENTERING CAFE-DOOR

RELATED APPLICATION

This application claims priority to U.S. Provisional Patent Application No. 61/221,338, filed on Jun. 29, 2009, by Peter Miller and Duer Miller; this application is also a continuation-in-part and claims the priority of U.S. patent application Ser. No. 12/079,772, titled OSCILLATING SELF-CENTERING CAFÉ-DOOR, by Peter Miller and Duer Miller filed on Mar. 28, 2008, that claims priority to the U.S. patent application Ser. No. 11/371,518, filed on Mar. 8, 2006, titled OSCILLATING SELF-CENTERING TRAFFIC-DOOR and also claims priority to the U.S. patent application Ser. No. 11/371,438, filed on Mar. 8, 2006, titled OSCILLATING SELF-CENTERING TRAFFIC-DOOR, which both claim priority to the provisional patent application Ser. No. 60/762,399, titled OSCILLATING SELF-CENTERING TRAFFIC-DOOR, by Peter Miller and Duer Miller filed on Jan. 26, 2006, are all incorporated by reference herein.

BACKGROUND OF THE INVENTION

1. Field of the Invention

This invention relates generally to interior doors and more particularly to cabinet mounted cafe doors.

2. Related Art

Often in restaurants, bars, retail stores, grocery stores and warehouses, interior café doors are used to separate one area from another part of the building. Traditionally, these doors separate the public area of a store from the back area/stock area of the store. Unlike a normal door, café doors are dividers that typically do not extend from the floor to the ceiling.

The requirement for a café door does vary, but in general they are self-centering bi-directional doors. Previous approaches to constructing a cafe door have included hinges externally mounted on a pin or poll. Often the moving parts require lubrication that collects dust and dirt. The dust and dirt create friction that degrades the opening of the door and may eventually causes failure of the cafe door. Further, the exposed moving parts are vulnerable to traffic that may hit exposed moving parts.

Other approaches have involved dual hinged doors where one set of hinges swings one direction and then another set of hinges enables the door to swing in the opposite direction. Problems with this approach and the other previous approaches include increased cost from additional hardware (extra hinges), and the inability of materials used in the café door to withstand the normal abuse encountered during normal use.

Therefore, there is a need for methods and systems for creating and installing café doors that overcomes the disadvantages set forth above.

SUMMARY

Systems and methods consistent with the present invention provide an approach for fabricating and operating an oscillating self-centering cafe-door. A beam may contain an oscillator that is rotatable about a support pin. The beam is configured to accept and support a panel that may be attached to the beam via a channel in the beam. The mounting of the support pin and configuration of the beam may also enable the oscillating self-centering café door to rotate. Alternately, the beam may support the pin that rotates on the oscillator that is fixed to or in the floor.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

Unlike the known approaches previously discussed, an oscillating self-centering café-door with a beam that enclose an oscillator is described.

Figure 1:
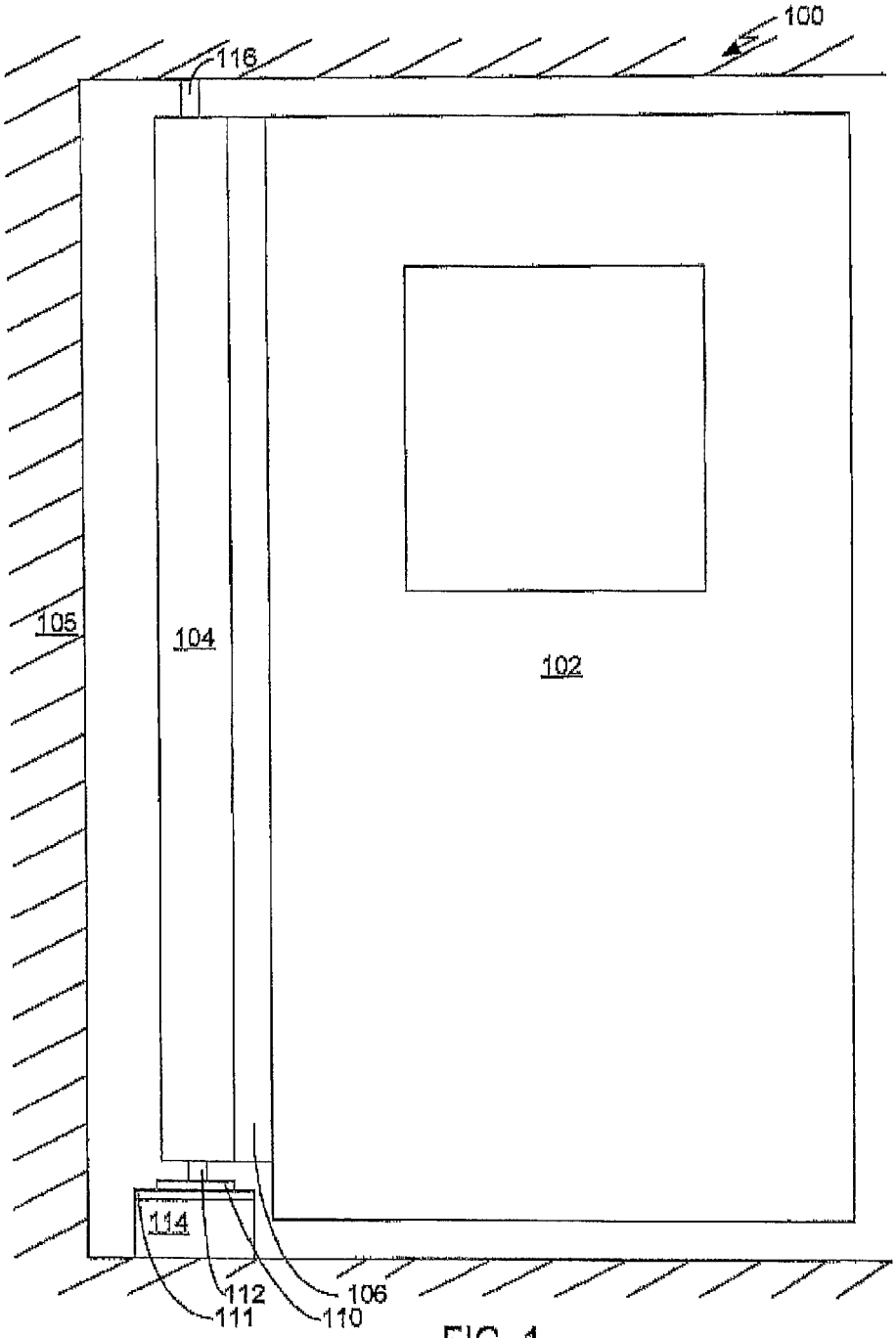
FIG. 1 illustrates an oscillating self-centering traffic-door with a beam in accordance with an example implementation of the invention.

Turning first to FIG. 1, an illustration 100 of an oscillating self-centering traffic-door with a beam 104 in accordance with an example implementation of the invention is shown. The oscillating self-centering traffic-door may be comprised of a door panel 102 that is attached to a beam 104 that has a centering pin 116 at the top of the beam 104 attached to the door jamb 105. The bottom of the beam 104 may contain an oscillator that engages a support pin 112. The support pin 112 may pass through an alignment plate 110 that may rest on a support plate 111. In other implementations, the support pin 112 may be fixed to a single support plate. The plate may be supported by a jamb guard 114 that may help protect the plate 110 and supporting pin 112 from strike damage. The door panel 102 and beam 104 may also have seals 118, 120, and 122 located around the door to prevent dust, odors, and hot/cold air from passing through the closed door.

The beam 104 may be attached to the door panel 102 by means of a channel 106 that clamps the door panel. The channel 106 may be glued, riveted, bolted or fastened using fasteners to the door panel 102. The channel 106 may be molded with the beam out of metal, welded to the beam 104 or attached with fasteners. In other implementations, other approaches to attaching a beam 104 to the door panel 102 may be used, such as having a notch part way or fully along the length of the beam 104.

Figure 2:
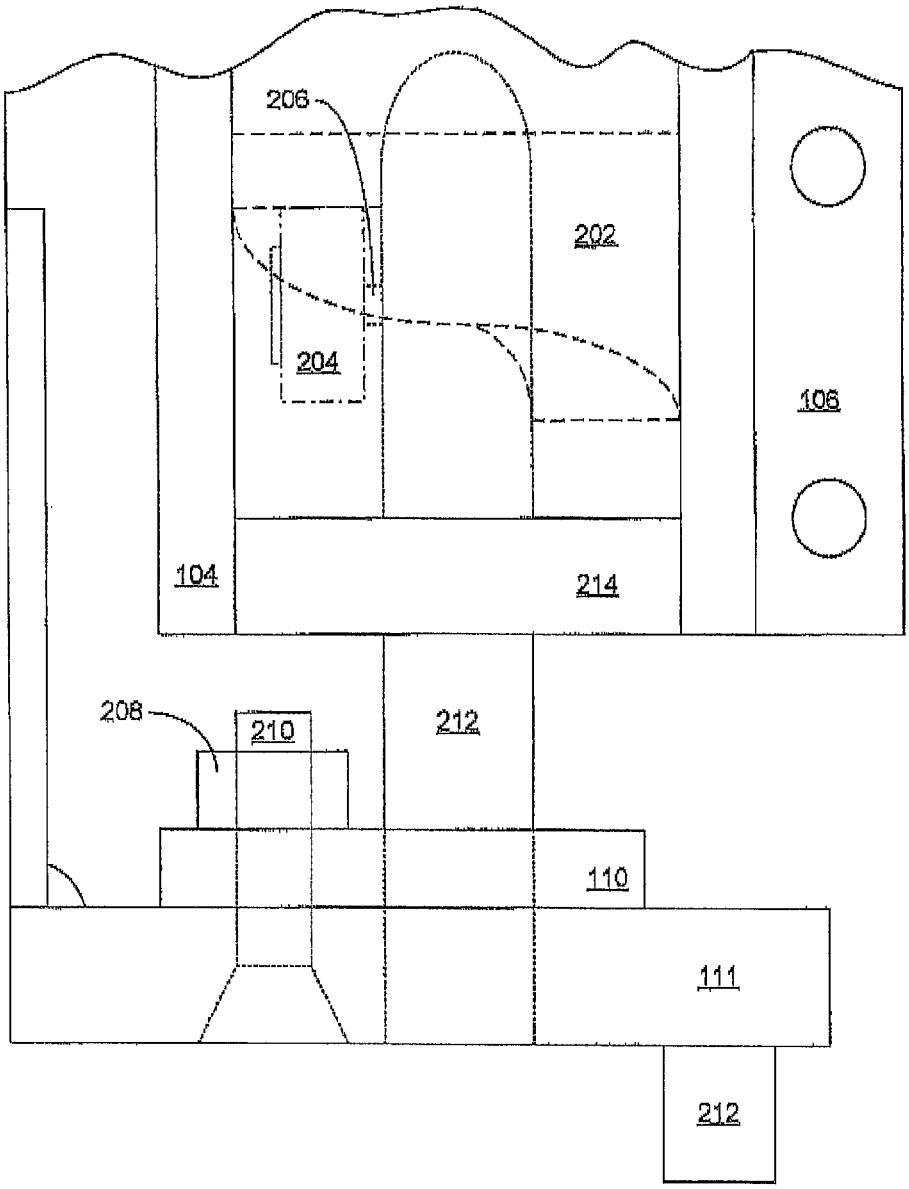
FIG. 2 illustrates an oscillating mechanism located within a beam of FIG. 1 in accordance with the example implementation of the invention.

In FIG. 2, an illustration of an oscillating mechanism 202 located within a beam 104 of FIG. 1 in accordance with the example implementation of the invention. The plate 110 may be bolted to the jamb guard 114 with bolt 210 and secured by nut 208. The support plate 111 may be further secured from movement by pin 212. Pin 212 may be molded with the support plate 111 or secured to support plate 111 by welding, screwing, or with other known approaches to securing a pin in a plate. Plate 110 may be configured to allow for adjustments to the supporting pin 112 that supports beam 104.

The supporting pin 112 enters the beam 104 and may have one or more support wheels, such as 204 attached to the supporting pin 112 by an axle 206. An oscillator 202 may be secured to the inside of the beam 104 and is able to rotate upon support wheel 204. The ends of the beams may be sealed using plugs, such as 214 that allow the support pin 112 to pass through and freely rotate. The beam 104 is also shown in FIG. 2, with channels 106 having holes for fasteners that would secure the door panel 102 to the beam. In another example implementation, the oscillator in the beam may be placed in a jamb guard or even in the floor with the beam being affixed or coupled to the shaft that sets into the jamb guard.

Figure 3:
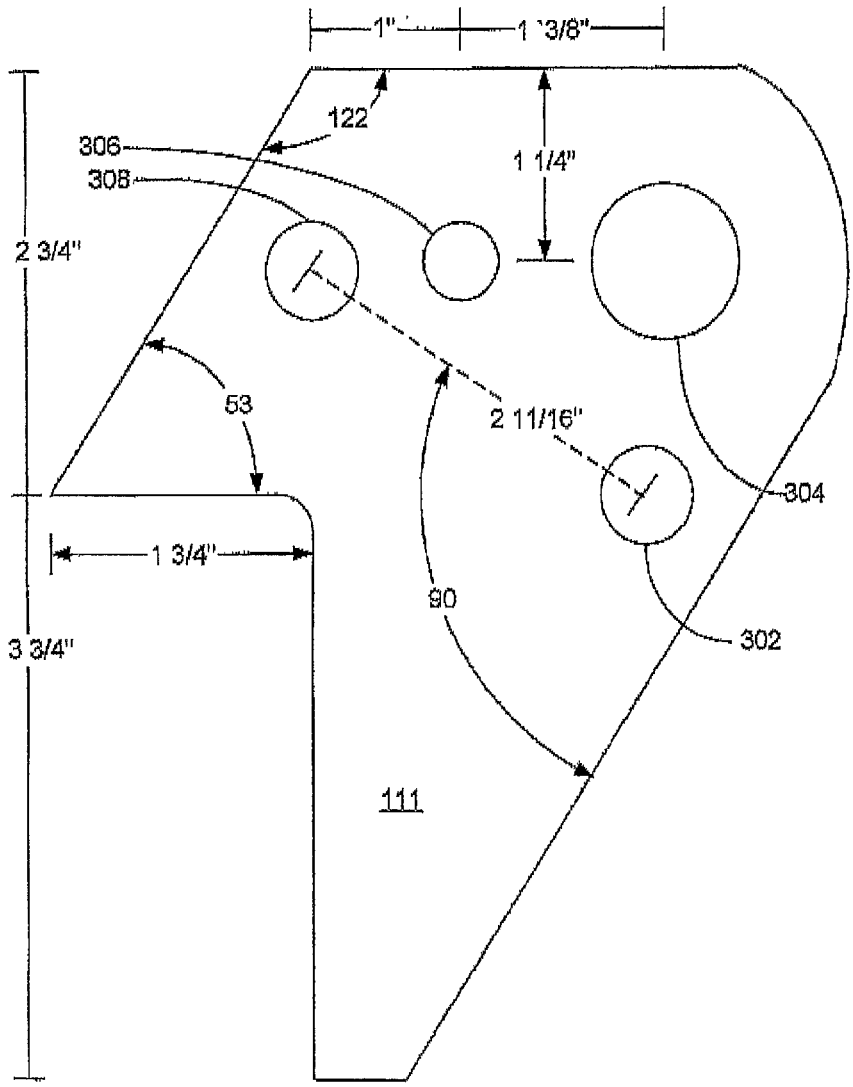
FIG. 3 illustrates a pin plate that supports the oscillating mechanism located in the beam of FIG. 2 in accordance with the example implementation of the invention.

Turing to FIG. 3, an illustration of a support plate 111 that steadies beam 104 of FIG. 2 in accordance with the example implementation of the invention is shown. The support plate 111 is shaped to allow an oscillating self-centering traffic-door to have a 270-degree range of motion. The support plate 111 may have a number of holes that enable pins and bolts to pass through it or to be fixed to the support plate 111. Hole 302 may have a radius of ⅝", hole 304 may have a radius of 1", hole 306 may have a radius of ½" and be tapped, while hole 308 may have a radius of ⅝". In other implementations, the number of holes, size of holes and shape of the support plate 111 may be changed and some of the holes may eliminate or additional holes may be added.

Figure 4:
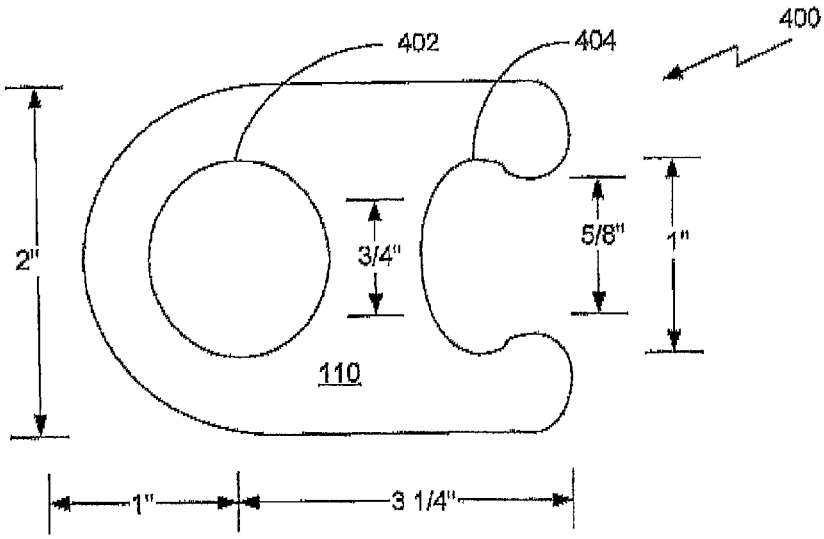
FIG. 4 illustrates an adjustment plate in accordance with the example implementations of the invention.

In FIG. 4, an illustration 400 of an adjustment plate 110 that adjusts the oscillating mechanism of FIG. 2 in accordance with the example implementation of the invention is shown. The adjustment plate 110 may have a hole 402 and a notch 404 opposite the hole. The arms of the notch partially enclose the notch 404 opening. The adjustment plate 110 may be used to adjust the bow of oscillating self-centering traffic-door and rest on the support plate 111. The adjustment plate 110 in other implementations may have more or fewer holes than shown in FIG. 4 and similarly, the notch may be shaped differently.

Figure 5:
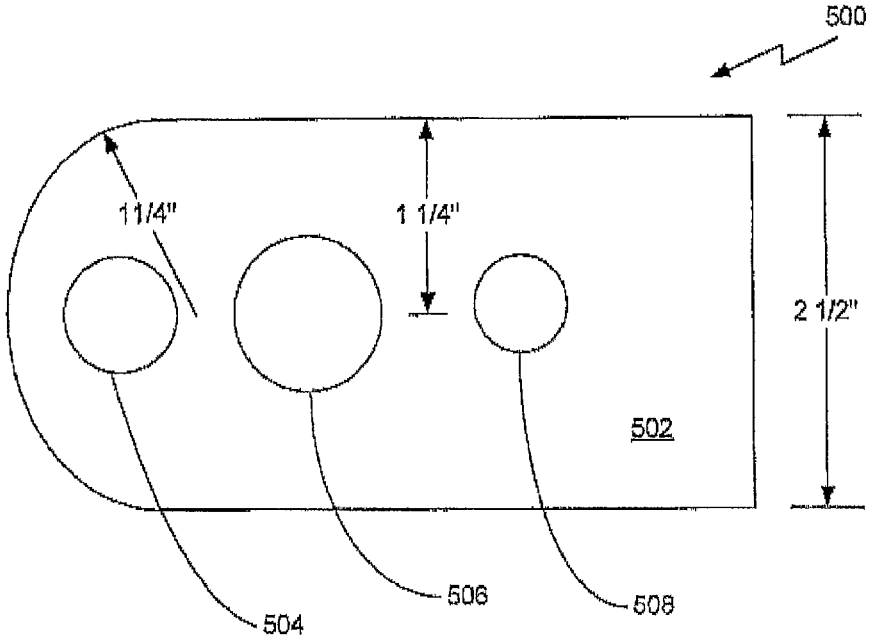
FIG. 5 illustrates another implementation of a pin plate that may be integral with the support pin of FIG. 2 in accordance with another example implementation of the invention.

In FIG. 5, an illustration 500 of another implementation of a support plate 502 that adjusts the oscillating mechanism of FIG. 2 in accordance with the example implementation of the invention is shown. The adjustment plate 502 may have a ⅝" hole 504, 1" hole 506 and another ½" tapped and counter sunk hole 508. The adjustment plate 502 may be used to adjust the bow of oscillating self-centering traffic-door and rest on the support plate 111. The adjustment plate 502 in other implementations may have more or fewer holes.

Figure 6:
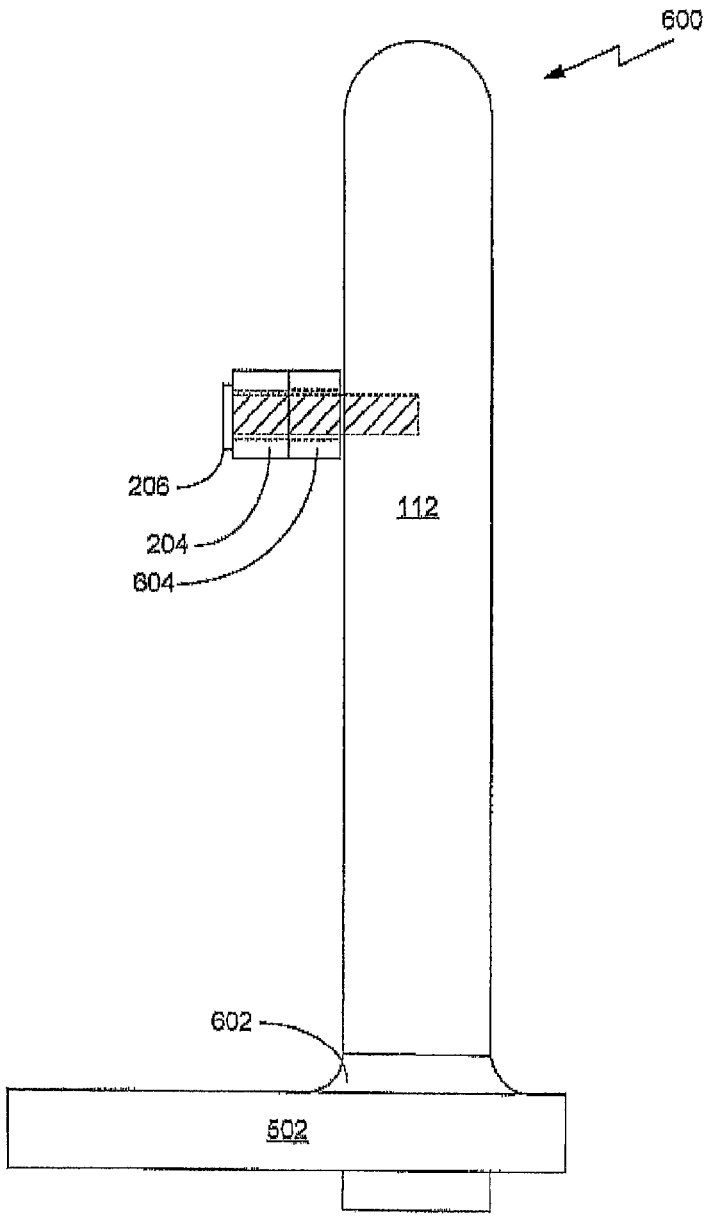
FIG. 6 illustrates a pin that supports the oscillating mechanism of FIG. 2 and passes through the pin plate of FIG. 5 in accordance with the example implementation of the invention.

Turning to FIG. 6, an illustration 600 of the pin 112 that supports the oscillating mechanism 202 of FIG. 2 and passes through the support plate of 502 of FIG. 5 in accordance with the example implementation of the invention is shown. The support pin 112 passes through support plate 502 and may be welded with a weld 602 to the adjustment plate 112. In other implementations, the connection between the support pin 112 and support plate 502 may be by friction, glue, bolt, or even one or more pins.

The upper portion of the support pin 112 may have a bolt 206 that is terminated in the support pin 112 and retains the support wheel 204 and a second support wheel 604. The support wheels may be made out of polyester, or other material with a low coefficient of friction. In other implementations, bearings may be used within the support wheels 204 and 604 to enable the support wheels 204 and 604 to turn.

Figure 7:
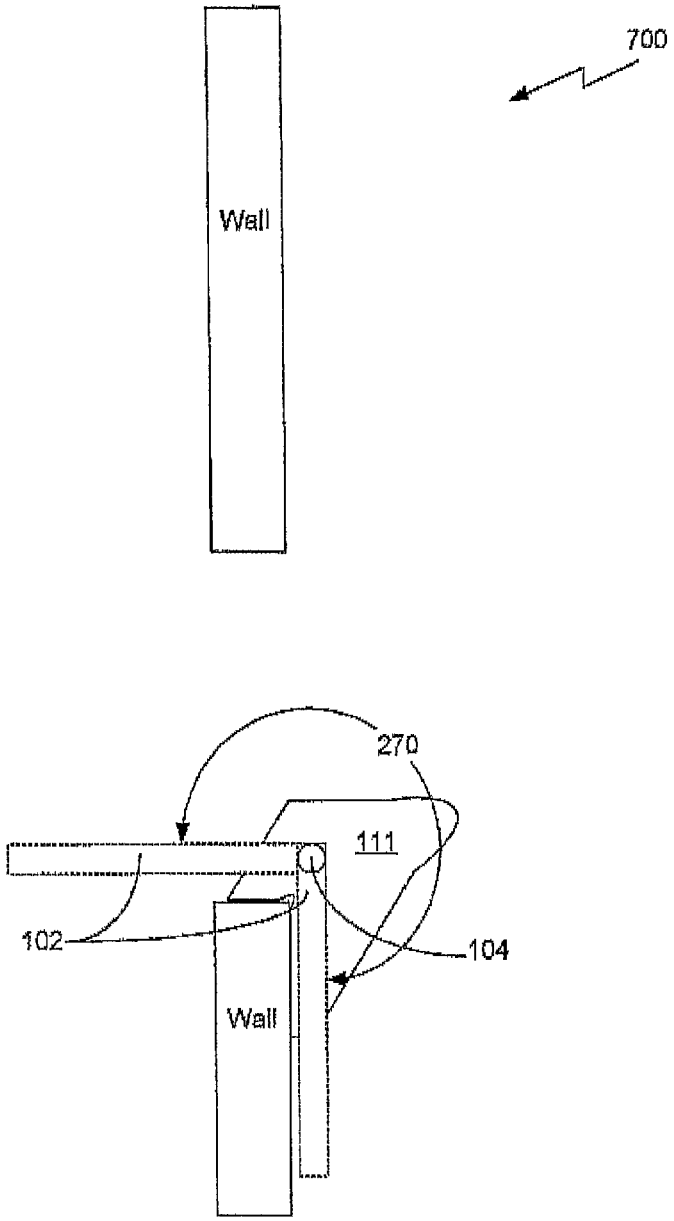
FIG. 7 illustrates the placement of the support plate that adjusts the oscillating mechanism of FIG. 2 and enables 270-degree operation of the oscillating self-centering traffic-door in accordance with the example implementation of the invention.

In FIG. 7, an illustration 700 of the placement of the support plate 111 that adjusts the oscillating mechanism of FIG. 2 and enables 270-degree operation of the oscillating self-centering traffic-door in accordance with the example implementation of the invention is shown. The support plate 111 locates the beam 104 partially out of alignment from the walls and enables the door panel 102 270-degrees of movement. The beam 102 and door panel may have seals that allow the opening around the door to provide a seal to block dirt, air, or odors from passing unobstructed through the door.

Figure 8:
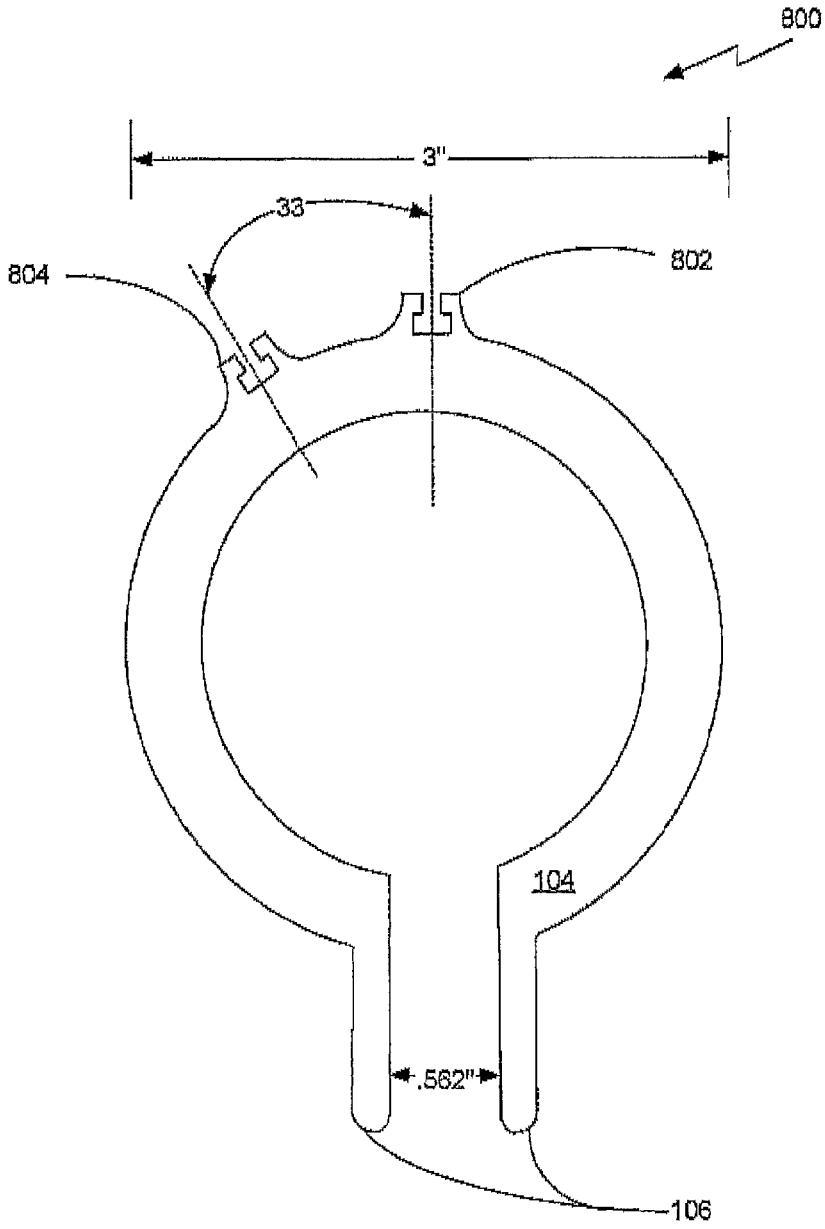
FIG. 8 illustrates a cross sectional view of a beam with door seal channels.

Turning to FIG. 8, an illustration 800 of a cross sectional view of beam 104 of FIG. 2 with seal channels 802 and 804 for door seals. The seal channels 802 and 804 for door seals are shown as being 33 degrees apart from the channels 106 that hold the door panel. When the oscillating self-centering traffic-door is in the closed position the seal channel 802 will be across from the door jamb and seals that reside in both seal channels 802 and 804 may engage the door jamb. When the oscillating self-centering traffic-door is open, one of the door seals may engage the door jamb. The door seals may be made out of rubber, plastic, or other structures that may seal the door without affecting the oscillating self-centering traffic-door's movement. In some implementations the seal may be a solid strip, while others the seal may be more like a brush.

Figure 9:
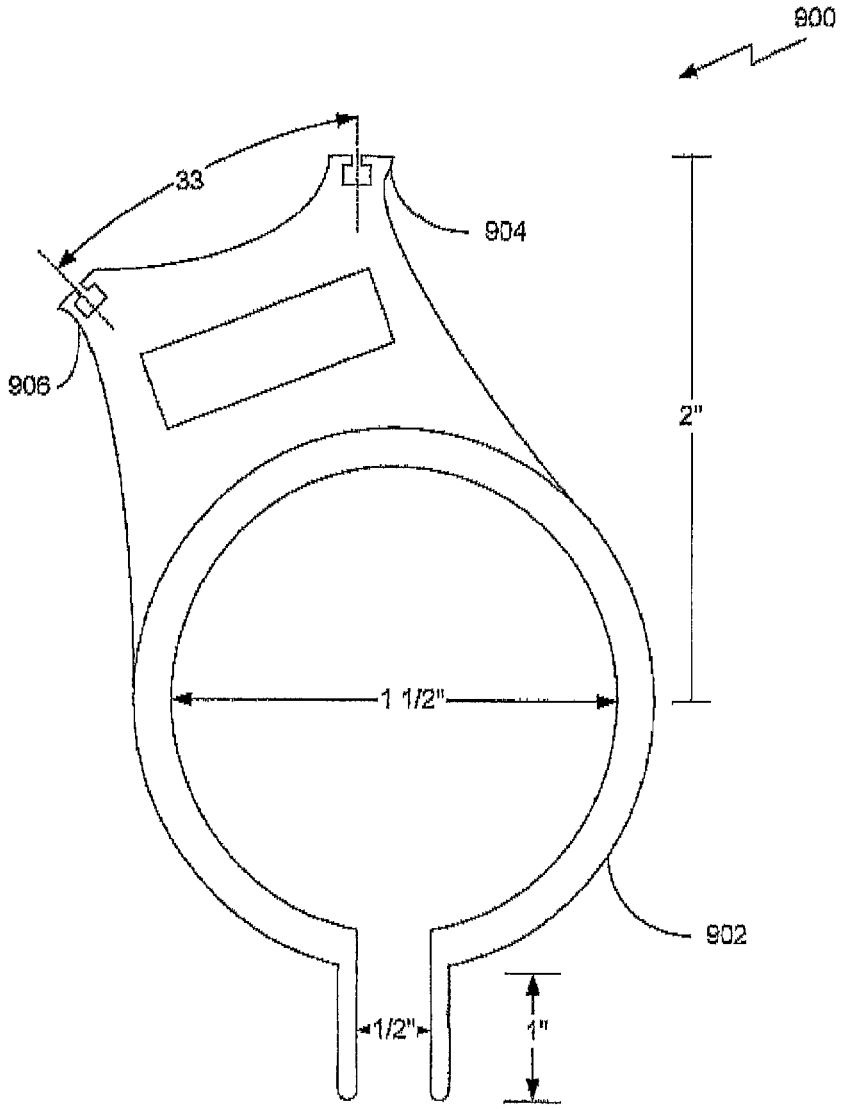
FIG. 9 illustrates a cross sectional view of a beam with two door seals that may be used with a support plate that enables 270 degrees of motion.

In FIG. 9, an illustration 900 of a cross sectional view of another beam 902 with two seals that may be used with the support plate that enables 270-degrees of motion is shown. The two seals may be fixed to the beam by seal channel 904 and 906. Unlike beam 104 of FIG. 8, the seal channels are rotated off center to enable the seal to be maintained through out the 270-degree opening. Similar to the beam 104 of FIG. 8, the seal channels 904 and 906 are spaced 33 degrees apart.

Figure 10:
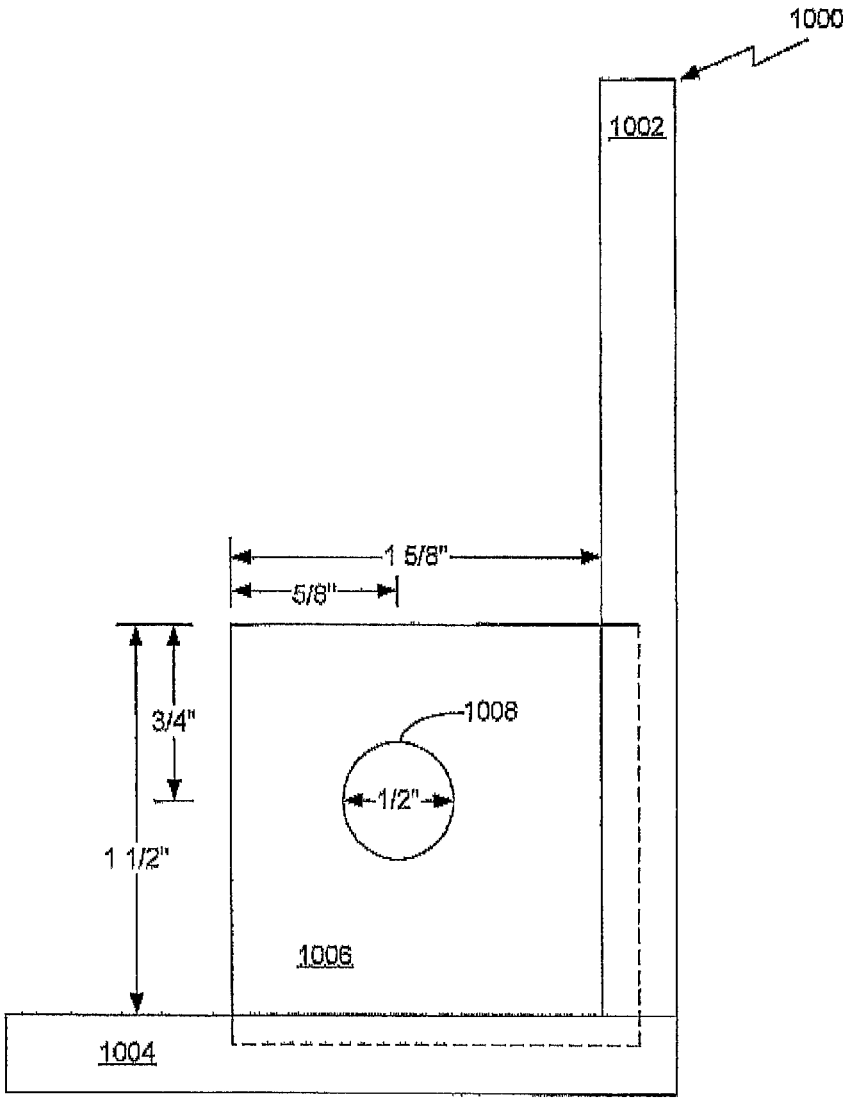
FIG. 10 illustrates a spline assembly that is fixed to a jamb plate and a floor plate in another example implementation of the invention.
Figure 11:
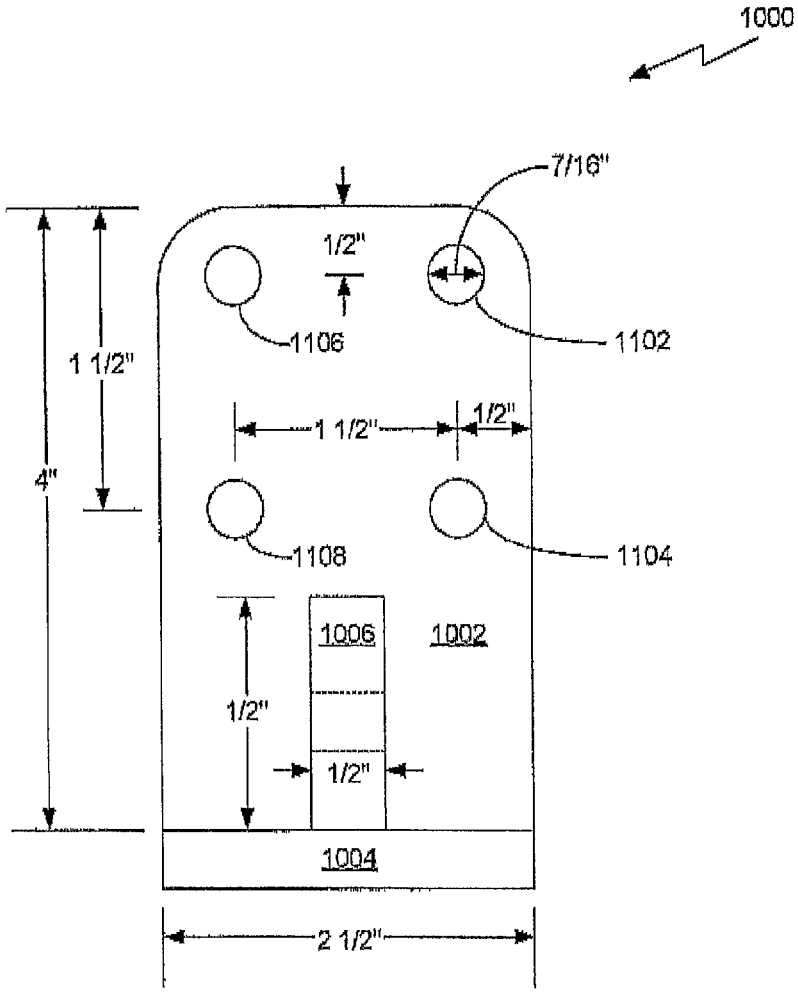
FIG. 11 illustrates another view of the spline assembly of FIG. 10, but facing the jamb plate.

In FIG. 10, an illustration of a spline assembly 1000 that is fixed to a jamb plate 1002 and a floor plate 1004 in another example of the invention is shown. The spline 1006 is attached to both the jamb plate 1002 and floor plate 1004 in the current example by welding, but in other implementations, it may be molded as single piece, screwed, bolted, or held by adhesives. The spline 1006 may have ½" hole 1008 that is able to have a bolt pass through it Turning to FIG. 11, an illustration of another view of the spline assembly 1000 of FIG. 10, but facing the jamb plate 1002. The spline 1006 is seen as being a half-inch wide and sitting on the floor plate 1004. The jamb plate 1002 may have holes, such as 1102, 1104, 1106, and 1108 for bolts, screws, or other types of fasteners to secure the spline assembly 1000 to the door jamb. It should be noted that the spline plate is secured to the door jamb but does not support the weight of a door off the door jamb, because the floor plate 1004 of the spline assembly 1000 rests on the floor.

Figure 12:
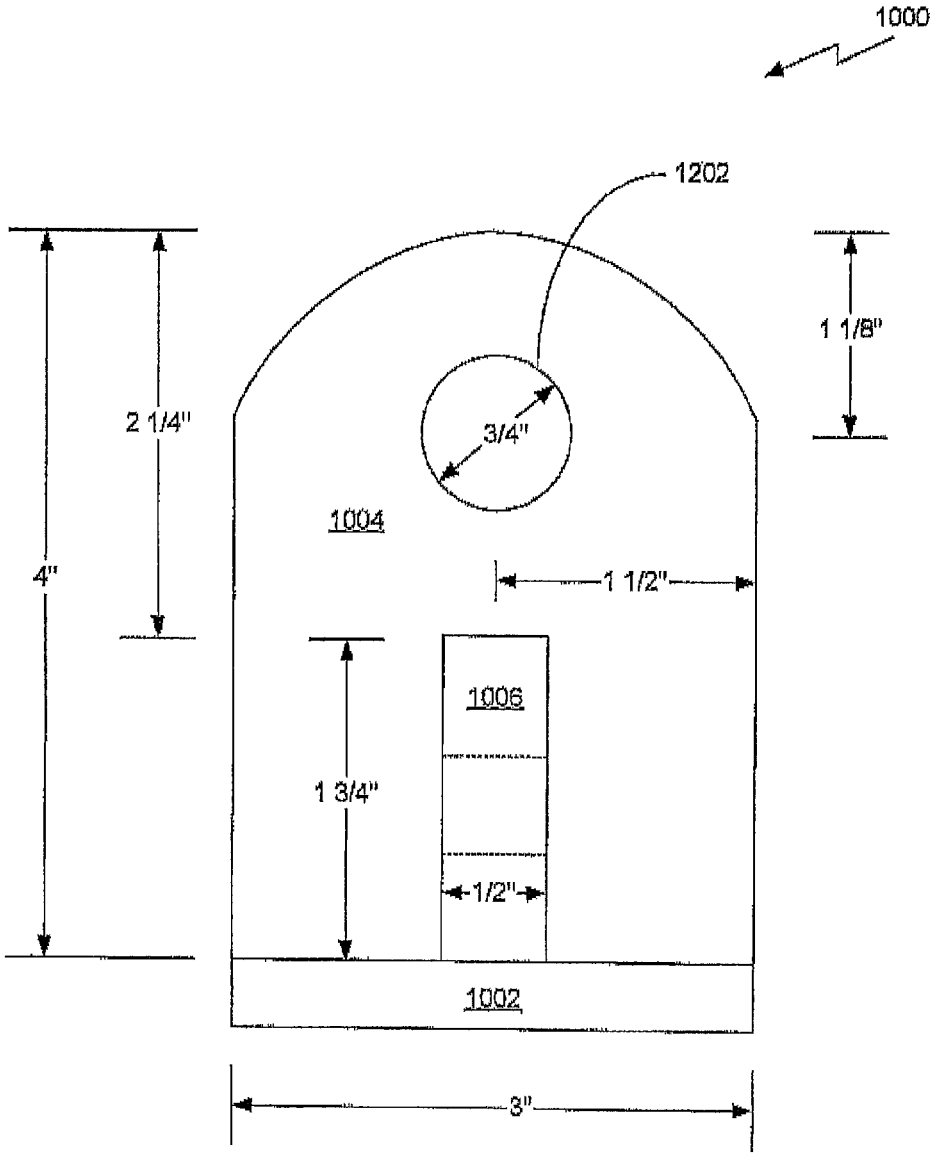
FIG. 12 illustrates another view of the spline assembly of FIG. 10, but facing the floor plate.

In FIG. 12, an illustration of another view of the spline assembly 1000 of FIG. 10, but facing the floor plate 1004 is shown. The floor plate 1004 rest upon the floor and may have a hole 1202 that aids in securing a door pin support. In other embodiments, the floor plate 1004 may have additional holes for fasteners to secure the floor plate 1004 to the floor.

Figure 13:
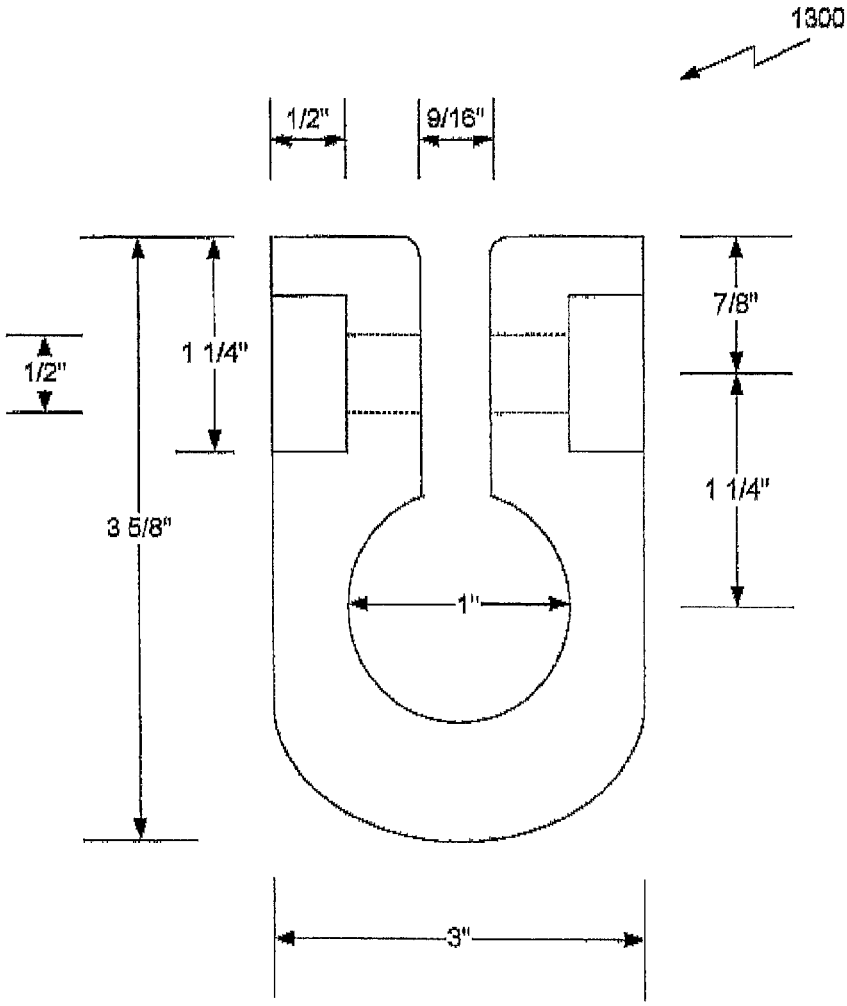
FIG. 13 illustrates a door pin support that secures to the spline assembly of FIG. 10.

Turning to FIG. 13, an illustration of a door pin support 1300 that secures to the spline assembly 1000 of FIG. 10 is shown. The door pin support 1300 may slide over spline 1006 with a hole the lines up with the spline hole 1008. A bolt or other type of fastener may then pass through the holes in the spline 1008 and door pin support 1300. A pin may then be supported and held firm in the one-inch opening in the spline hole 1008. In this arrangement the oscillator may be in beam that is attached to a door panel. In other examples, the door pin support may secure the oscillator and the door panel may secure a pin that is rotatable in the oscillator.

Figure 14:
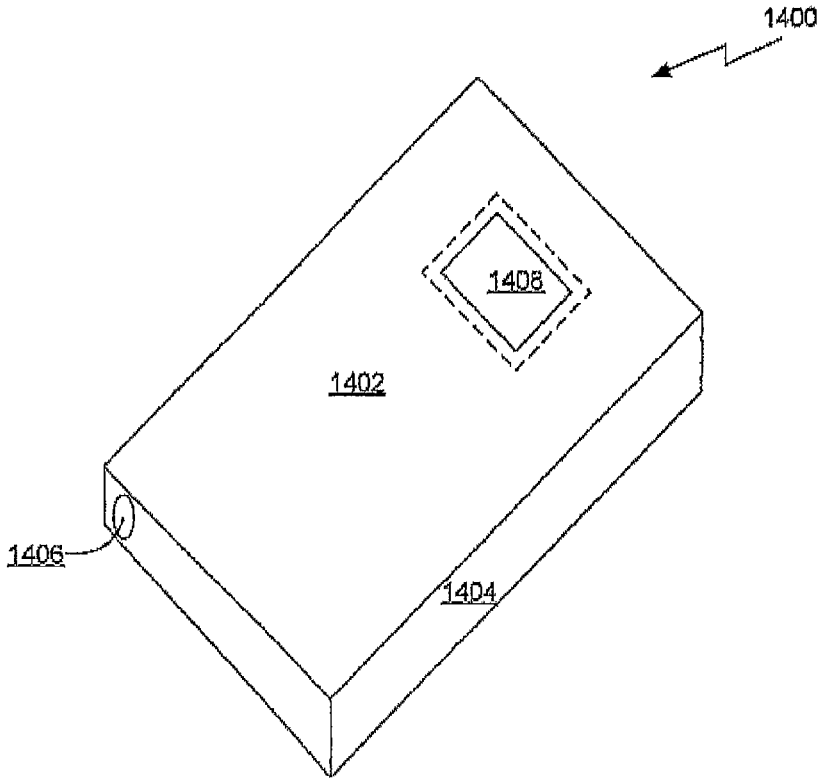
FIG. 14 illustrates a molded door panel with window in accordance with another embodiment of the invention.

FIG. 14 illustrates a molded door panel 1400 with window 1408 in accordance with another example of the invention. The molded door panel 1400 has a surface 1402 and edges 1404. The edges 1404 may form a frame by coating the edges with an elastomeric polyurethane spray. Typically two or more coats may be applied with the edges 1404 being coated first to form a more secure frame that prevents warping when the main sections of the surface 1402 of the door panel 1400 is coated. For example, the door panel or door panel and beam may be molded with a coating of KEVLON, a thermosetting, polymetric encapsolent, formed around a closed-cell insulator resistant to moisture, retaining its initial insulator properties even following prolonged exposure to water leakage, humidity, condensation and freeze-thaw cycling.

The core material of the door panel may be polystyrene, polyurethane, wood, metal, paperboard, fiberglass, or materials that form a frame for a panel. The panels may be an insolated door panel with the core material being composed of a material that slows the transfer of heat or cold. The molded door panel may be used with a full or partial beam 1406. One or more windows 1402 may be molded into the door and held in place by over spray of the coating material. The window 1402 may be made out of a Lexan polycarbonate. In other example implementations, the windows may be held in place by a frame that is secured with screws or other type fasteners.

A high-density panel (i.e. solid not molded) may also be used with a full or partial beam. Holes in the high-density panel may be formed in order to prevent stress bending of the panel when the beam is clamped onto the high-density panel.

The door panels may be used for all types of doors, including but not limited to oscillating self-centering traffic-doors. For example, garage doors, home access doors, semi-trailer doors, train car doors. Further more, molded panels may also be formed for use in partitions and dividers.

Figure 15:
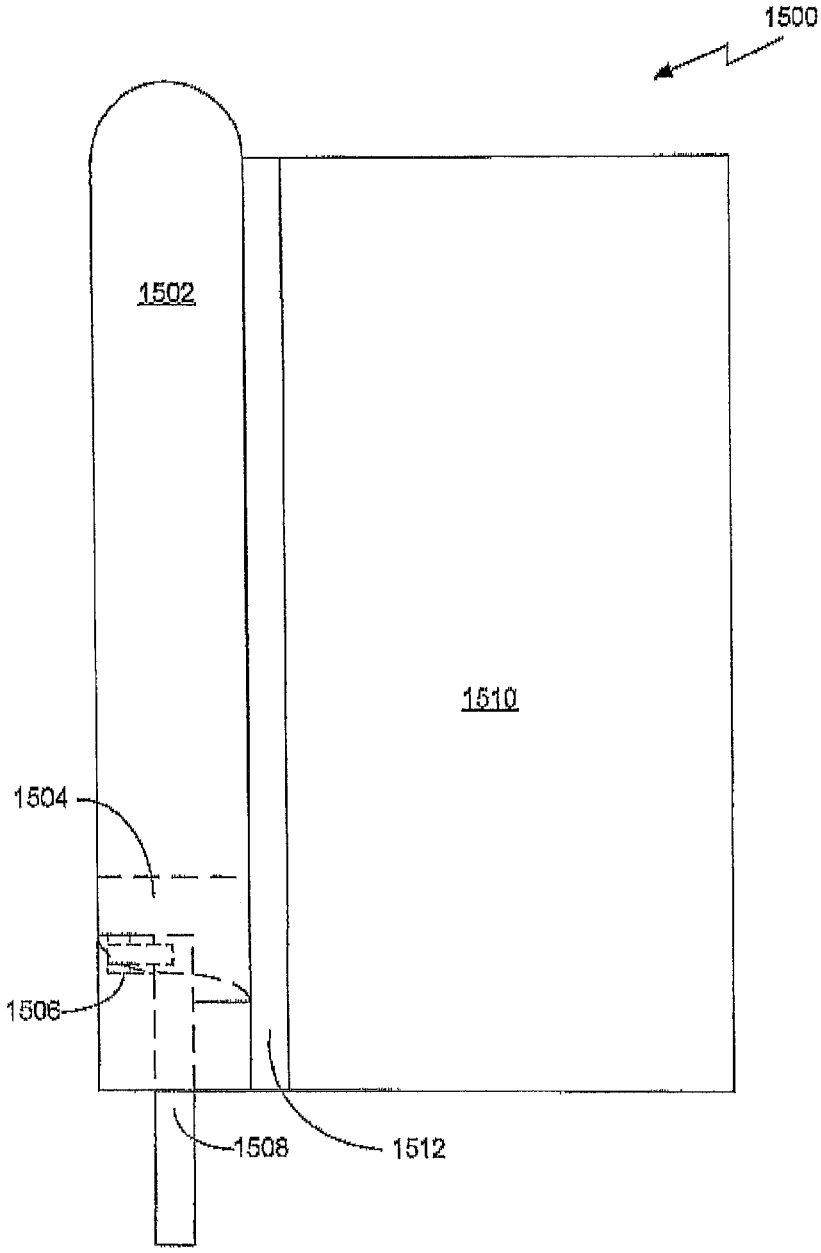
FIG. 15 illustrates a freestanding café door with a post that contains an oscillator in accordance with another embodiment of the invention.

In FIG. 15, an illustration of a freestanding door 1500 with a beam 1502 that contains an oscillator 1504 in accordance with another embodiment of the invention. Such doors may be commonly found in bars and by sales counters and divide an area behind the bar or counter from the other public areas and are often referred to as a café door. The beam 1502 may be a full or partial beam and contain an oscillator 1504. The oscillator 1504 is secured in the beam 1502 and rest on one or more wheels or bearings 1506 that are attached by a support or axel to a pin 1508 that may be secured to the floor. The pin 1508 may be the sole secure point to support the beam via the one or more wheels and may be secured to a bracket bolted to the floor (not shown) or may have the pin 1508 embedded or sunken into the floor. The beam 1502 may have an area 1512 for clamping onto a door panel 1510, or may be molded to or in the panel as explained previously. In other implementations, the oscillator 1504 may be secured to a plate or pin on the floor (the oscillator is located complete within the beam), while one or more wheels or bearings are secured to a pin via an axel or other support with the pin being coupled to the beam.

Figure 16:
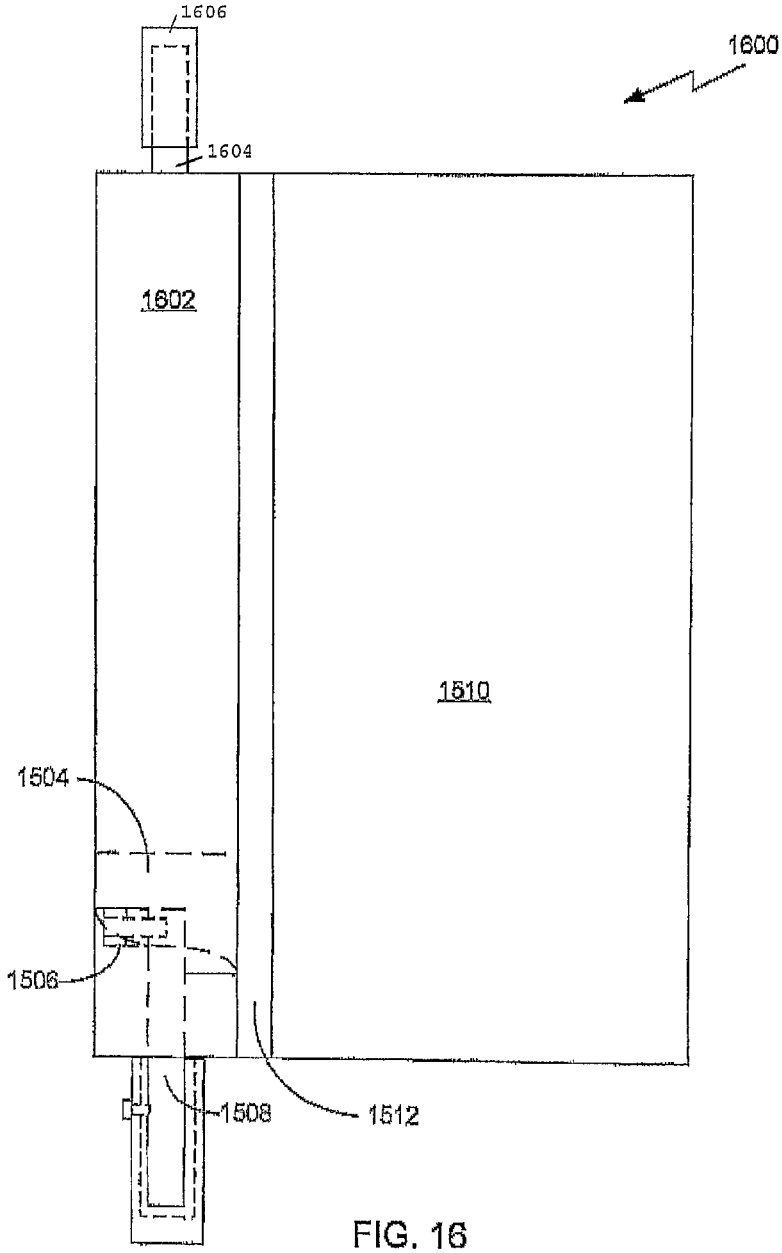
FIG. 16 illustrates a cabinet mounted café door with a beam that contains an oscillator in accordance with another embodiment of the invention.

In FIG. 16, an illustration of a cabinet mounted café door 1600 with a beam 1602 that contains an oscillator 1504 in accordance with another embodiment of the invention is shown. The beam 1602 may have a top pin 1604 that is held in place by a support hinge made up of an support block that is securable to a vertical surface, such as a wall or cabinet and an upper support portion 1606 that connects to both the block portion and the beam 1602. The connection from the beam 1602 may be via the top pin 1604 that extends from the beam. The top pin 1604 may be fixed by clamping force, fasteners, or adhesives to the beam and rotate in the upper support portion 1606 as shown in FIG. 16. In other implementations, the beam 1602 may form a hole for receiving the top pin that is held in place or fixed with a clamping force, fasteners, or adhesives in the upper support portion 1606. In yet other implementations, the top pin 102 may sit in the beam 1602 and the upper support block 1606. Additional materials, such as bearings or other plastics may be used to aid in reducing the friction between the pin and either the support portion or beam depending upon the implementations.

The lower pin 1508 that supports the oscillator 1506 may also be supported by a support portion that secures to a block portion which is mountable on a vertical surface. The pin supporting the oscillator is fixed, secured or formed so the lower pin 1508 does not move. This may be accomplished using set screws, securing pins, glue, friction, or being formed as an integrated unit (lower pin and support portion).

Figure 17:
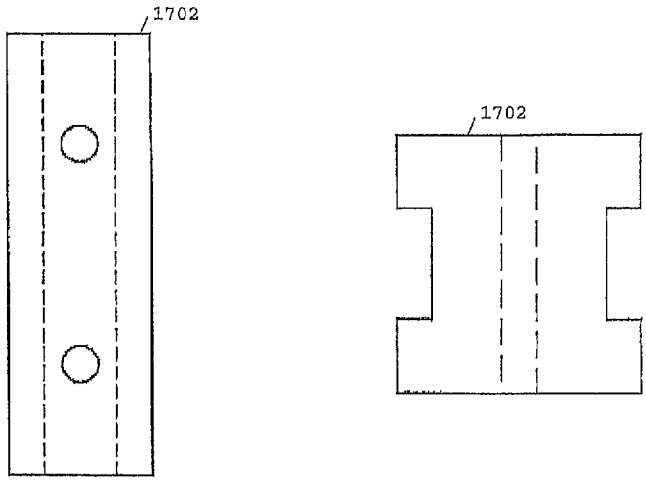
FIG. 17 illustrates a support block portion of a support hinge that is able to be attached to a vertical surface in accordance with an embodiment of the invention.

Turning to FIG. 17, an illustration of two views of the support block 1702 of the support hinge that is able to be attached to a vertical surface in accordance with an embodiment of the invention is shown. The support block 1702 may have one or more channels that match channels in the upper support portion 1606 of FIG. 16. The support block 1702 may be secured to a vertical surface by fasteners; examples of fasteners include screws, rivets, nails, and glue. The upper support portion 1606 may then slide over the support block 1702. Once over the bock portion, the support portion may be secured in place with screws, pins, glue.

Figure 18:
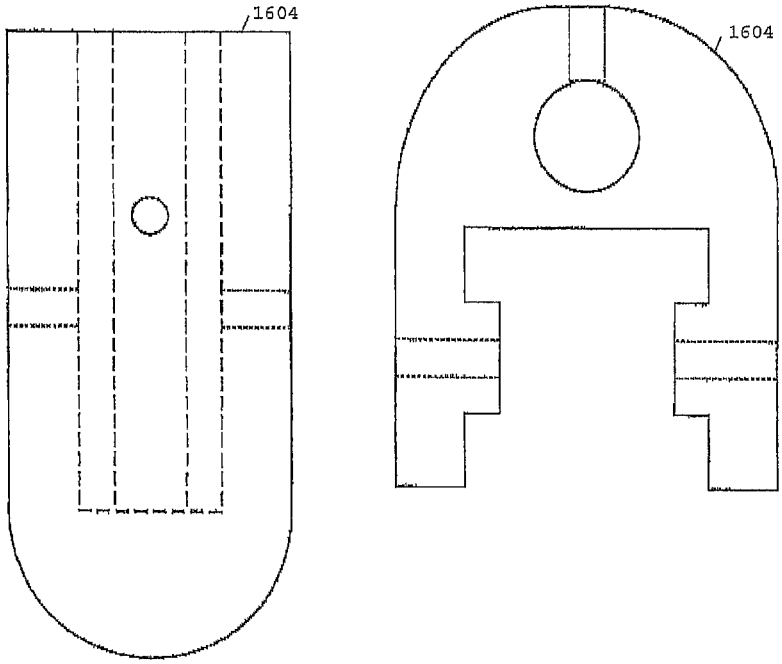
FIG. 18 illustrates the support portion of a support hinge that may be placed over the support block portion of FIG. 17.

In FIG. 18, an illustration of two views of the upper support portion 1606 of a support hinge of FIG. 16 that may be placed over the support block portion of FIG. 17 is shown. The support portion 1606 may have sides that are adapted to receive the block portion. The upper support portion also may have a cavity or hole that accepts a pin that is associated with the beam of the café door. In other implementations the support bock 1702 and upper support portion 1606 of the support hinge may be a single integrated support hinge that is both attached to the vertical surface and accepts, holds, or has a pin.

Figure 19:
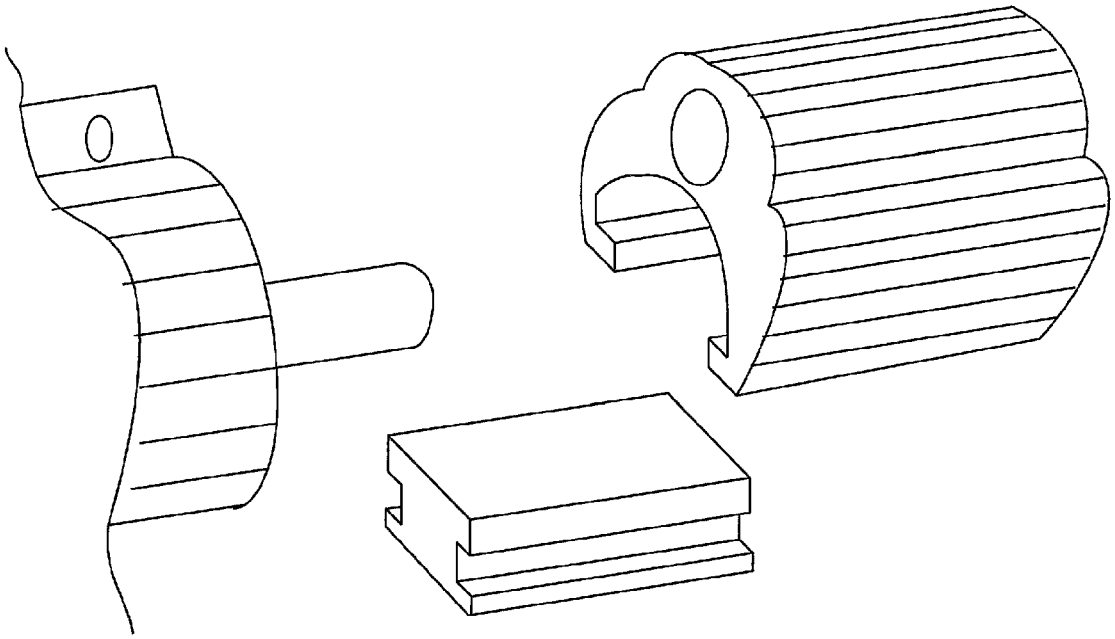
FIG. 19 illustrates the beam having a pin that is able to be held by a lower support portion and a support block portion in accordance with an embodiment of the invention.

Turning to FIG. 19, an illustration of the beam 1602 having a lower pin 1508 that is able to be held by a lower support portion 1902 and a support block portion 1904 in accordance with an embodiment of the invention is shown. The beam may have a lower pin 1508 that is associated with the oscillator. The pin is able to be set in the support portion 1902 of the support hinge. The support block 1904 may be affixed to a vertical surface and is able to accept the support portion 1902 of the support hinge. The order of assembly may be affix to the support bock 1904, slide support portion 1902 of the support hinge over the lower pin 1508 extending from the beam and the support bock 1904. In FIG. 19, the lower pin extending from the beam is located at the bottom of the café door. In other implementations, the pin may be located at the top of the café door. The support portion may be formed with ridges or other decorative designs.

Figure 20:
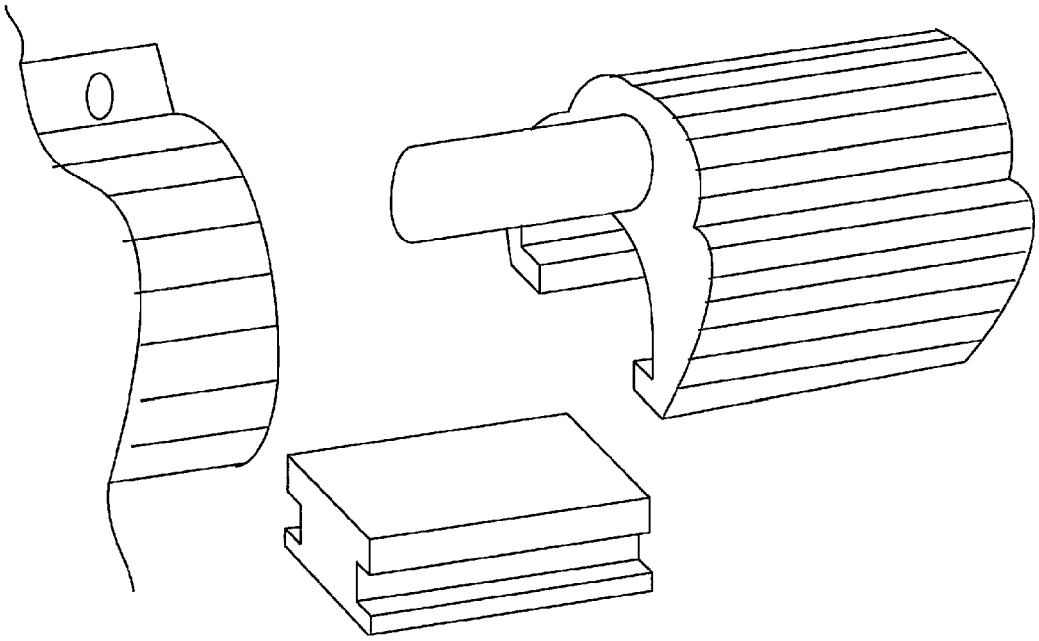
FIG. 20 illustrates the beam having an area able to accept a pin being held by an upper support portion where the upper support portion is held to a cabinet by the support block of FIG. 17 in accordance with an embodiment of the invention.

In FIG. 20, an illustration of the beam having an area able to accept an upper pin being held by an upper support portion 1606 where the upper support portion 1606 is held to a cabinet by the support block 1702 of FIG. 17 in accordance with an embodiment of the invention is shown. The support block 1702 is secured to a vertical surface and the support portion having a pin extending from the upper support portion 1606 may be secured to the support block with the pin extending into the beam 1602. In this example implementation the pin is not formed with the support block 1702, but rather inserted into the support block 1702 and secured in a similar manner as the pin that supports the oscillator 1504. In other implementations, the top pin 1604 be part of the beam and extend into the support portion of the support hinge.

The self-oscillating traffic-doors or other type of door may be placed into a test jig that holds the door stationary with the bottom shaft is allowed to fully rotate. The shaft has a pin and rollers that engage an oscillator as would occur during the normal operation of the door. The shaft is connected to an electric motor that may have gears for controlling torque via a coupler. The shaft is then rotated at a predetermined speed for a predetermined amount of time. A speed in the current example is 40 rotations per minute (RPM). The door assembly mounted in the floor to the fixture type frame directly below the beam next to jamb.

The door motion may be in the vertical direction only. This test may be complete after a predetermined number of rotations, such as 1,300,000 cycles of rotation with no impact on operation of shaft, rotator, or oscillator and no additional lubrication being applied. Upon termination of the test, the door and beam should function as prior to the test.

Another test of the door, may verify that the door panel with stand impact and negative pressure. Negative pressure is typically what traffic doors experience because of the "chimney effect" found in a structure. Air is drawn through various openings from the perimeter of a store and traffic-doors prevent this air movement into sales area of a store. A self-oscillating traffic-door should be capable of being held in a closed position against typical negative pressure without requiring excessive force for an employee to open. A negative pressure no greater than 0.06 in. W.C. as measured on a manometer is considered ideal. Traffic doors that can hold closed to a higher negative pressure than 0.06 in. W.C. creates difficulty for employees to go through the opening and result in excessive wear on the moving parts and face of the door panel. This measure may apply to solid panel doors, molded panel doors and sandwich panel doors.

Impact resistance is a desirable feature for traffic doors. A ¼" thick solid panel should be impact resistant to 200 foot-pounds. For example, from a 1-inch diameter steel dart weighing 5 pounds dropped from a height of 40 feet or equivalent force if projected horizontally. A ½" thick solid panel should be impact resistant to a 200 foot-pounds. For example, a 1-inch diameter steel dart weighing 5 pounds dropped from a height of 40 feet or equivalent force if projected horizontally. Minor dents in the door panel that do not affect the alignment of the door are acceptable results.

A ⅛" thick sandwich paneled door panel should be impact resistant to 100 foot-pounds. For example, from a 1-inch diameter steel dart weighing 2.5 pounds dropped from a height of 40 feet or equivalent force if projected horizontally. ⅛" thick skins over a foam material panel should be impact resistant to a 200 foot-pounds. For example, a 1-inch diameter steel dart weighing 5 pounds dropped from a height of 40 feet or equivalent force if projected horizontally. Minor dents in the door panel that do not affect the alignment of the door are acceptable results.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A cafe door, comprising:

a door panel having an edge;

a beam attached to the edge of the door panel; and an oscillator, located in and secured to the beam, associated with a support pin that enables the beam to rotate.

2. The café door of claim 1, where an upper hinge rotatably holds a top of the beam.

3. The upper hinge of claim 2, further includes an upper support portion and a support block.

4. The support block of claim 3, where the upper support portion slides over the support block.

5. The upper support portion of claim 3, further include a top pin extending from a top of the beam held in place by the upper support portion.

6. The upper support portion of claim 3, further includes a decorative design.

7. The café door of claim 1, where the beam attached to the edge of the door panel is the beam and the door panel are coated with a polymeric encapsolent.

8. The café door of claim 1 where the oscillator is supported by an at least one wheel secured by an axle to the support pin.

9. The café door of claim 8 where the at least one wheel is a bearing.

10. The café door of claim 1, where the support pin is mounted in a fixture adapted for securing to a floor.

11. The café door of claim 1, where the support pin is mounted in a fixture adapted for securing to a vertical surface.

12. The café door of claim 1 where the café door panel is coated with a polymeric encapsolent.

13. The café door of claim 1, where the door panel includes one or more holes.

14. The café door of claim 1, where the oscillator is able to rotate 1,300,000 cycles without failure.

* * * * *